US007214153B2

(12) United States Patent
Simpson

(10) Patent No.: US 7,214,153 B2
(45) Date of Patent: May 8, 2007

(54) METHOD OF CHANGING THE DUTY CYCLE FREQUENCY OF A PWM SOLENOID ON A CAM PHASER TO INCREASE COMPLIANCE IN A TIMING DRIVE

(75) Inventor: Roger T. Simpson, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 626 days.

(21) Appl. No.: 10/701,189

(22) Filed: Nov. 4, 2003

(65) Prior Publication Data

US 2005/0014586 A1 Jan. 20, 2005

Related U.S. Application Data

(60) Provisional application No. 60/488,272, filed on Jul. 18, 2003.

(51) Int. Cl.
*F01L 1/34* (2006.01)
*F16H 7/08* (2006.01)
*H01H 19/62* (2006.01)

(52) U.S. Cl. ..... 474/101; 123/90.17; 464/2; 74/568 R

(58) Field of Classification Search ..... 474/101, 474/110, 111; 123/90.15, 90.17, 90.31, 90.12; 74/586 R See application file for complete search history.

(56) References Cited

U.S. PATENT DOCUMENTS 5,002,023 A * 3/1991 Butterfield et al. ..... 123/90.15
5,088,456 A * 2/1992 Suga ..... 123/90.17
5,172,659 A 12/1992 Butterfield et al. ..... 123/90.17
5,327,859 A 7/1994 Pierik et al. ..... 123/90.17
5,497,738 A * 3/1996 Siemon et al. ..... 123/90.17
5,577,970 A 11/1996 Smith et al. ..... 474/110
5,628,701 A 5/1997 Dembosky et al. ..... 474/103
5,643,117 A 7/1997 Dembosky ..... 474/110
5,657,725 A * 8/1997 Butterfield et al. ..... 123/90.17
5,967,920 A 10/1999 Dembosky et al. ..... 474/109
5,993,342 A 11/1999 Wigsten et al. ..... 474/110
6,117,033 A 9/2000 Simpson ..... 474/110
6,250,265 B1 * 6/2001 Simpson ..... 123/90.17
6,311,658 B2 * 11/2001 Eguchi ..... 123/90.17
6,338,323 B1 1/2002 Machida
6,453,859 B1 * 9/2002 Smith et al. ..... 123/90.17
6,477,999 B1 * 11/2002 Markley ..... 123/90.17
6,481,402 B1 * 11/2002 Simpson et al. ..... 123/90.17
6,561,146 B2 5/2003 Todd et al. ..... 123/90.15
2003/0047395 A1 3/2003 Patton ..... 188/266.7

FOREIGN PATENT DOCUMENTS

JP 2001134479 5/2001

* cited by examiner

*Primary Examiner*—Marcus Charles
(74) *Attorney, Agent, or Firm*—Brown & Michaels, PC; Greg Dziegielewski

(57) ABSTRACT

A chain drive having a phaser such as a hydraulic vane phaser interposed between a timing chain and a driving or driven shaft is provided. The phaser or the vane are controlled to oscillate more at certain engine speeds to thereby reduce the tensioning force on the chain at the certain engine speeds.

8 Claims, 6 Drawing Sheets

METHOD OF CHANGING THE DUTY CYCLE FREQUENCY OF A PWM SOLENOID ON A CAM PHASER TO INCREASE COMPLIANCE IN A TIMING DRIVE

REFERENCE TO PROVISIONAL APPLICATION

This application claims an invention which was disclosed in Provisional Application No. 60/488,272, filed Jul. 18, 2003, entitled METHOD OF CHANGING THE DUTY CYCLE FREQUENCY OF A PWM SOLENOID ON A CTA CAM PHASER TO INCREASE COMPLIANCE IN A TIMING DRIVE. The benefit under 35 USC §119(e) of the U.S. provisional application is hereby claimed, and the aforementioned application is hereby incorporated herein by reference.

FIELD OF THE INVENTION

The invention pertains to the field of variable cam timing (VCT) systems. More particularly, the invention pertains to a method of changing the duty cycle frequency of a PWM solenoid on a cam phaser to increase compliance in a timing drive.

BACKGROUND OF THE INVENTION

Traditionally, the camshaft (or, in a multiple camshaft engine, camshafts) of an internal combustion engine, which actuates the intake and/or exhaust valves, is connected to the crankshaft, which receives the force from the pistons, by a timing chain, belt or gear arrangement driving sprockets, pulleys or gears, respectively, on the ends of the shafts. The relative timing of the camshaft(s) and crankshaft in such a system is fixed, and must be chosen to be tailored to power or economy at a given engine speed or load condition. This is inherently a compromise, as an automobile engine does not, obviously, always run at the same speed or load, and a given car owner might desire either power or economy at different times. The demands of emissions control complicate matters further.

This has given rise to Variable Cam Timing (VCT) systems, where the timing of the valves relative to the crankshaft can be changed by altering the relative rotational positions of the camshaft(s) and crankshaft. One of the more successful systems for VCT involves using a device called a "phaser" to allow the camshaft sprocket, which is linked to the crankshaft by the timing chain, to shift angular position relative to the end of the camshaft. Typically, the phaser is a coaxial arrangement of an outer housing which forms the sprocket (or pulley or gear) and an inner rotor fixed to the camshaft. The angular position of the rotor and housing can be shifted by fluid pressure acting on pistons or vanes on the rotor inside cylinders or chambers formed in the housing.

The "vane phaser" setup is commonly used in VCT systems, and will be used in the examples in this disclosure, although it will be understood that the method of the invention will work with other forms of phasers known to the art. Butterfield and Smith, U.S. Pat. No. 5,172,659, "Differential Pressure Control System for Variable Camshaft Timing System", assigned to BorgWarner Inc., shows a vane phaser system which uses the inherent torque reversals in the camshaft caused by the actuation of the valves to move the vane from one position to another. Fluid is led from one side of each vane to the opposing side through a valve. When the valve is open, the rotor is free to oscillate, the fluid passing freely from one side of the vane to the other. When the valve is closed, the fluid cannot flow, and the vane is held in position. By opening the valve while the torque reversal is acting to move the camshaft in the desired direction, then closing the valve, the camshaft is allowed to move, then held in place by the fluid on each side of the vane.

U.S. patent application No. 20030047395, entitled CONTROL SYSTEM FOR VIBRATION EMPLOYING PIEZOELECTRIC STRAIN ACTUATORS by Patton, Mark E. teaches a vibration control system for an engine or transmission cover on a motor vehicle to absorb and dissipate gear or chain-induced vibration uses a piezoelectric strain actuator with a passive resonant control system to absorb and dissipate vibration at a fixed resonance frequency of transmission and engine timing covers. Another embodiment uses an open-loop active control system, based on signals already existing on-board in the engine controller and a control map of phase, amplitude and frequency. Still another embodiment employs a hybrid system, combining open- and closed-loop control.

U.S. Pat. No. 6,561,146, entitled METHOD OF CONTROLLING RESONANCES IN INTERNAL COMBUSTION ENGINE HAVING VARIABLE CAM TIMING by Todd, et al. teaches a method of controlling resonances in timing drive systems for internal combustion engines having variable cam timing systems using cam phasers with the capability of being locked in position. Locking or unlocking the phaser changes the resonant characteristics of the timing drive system. The invention uses these changes in characteristics between locked and unlocked phasers to minimize the effects of resonance in timing drives by changing between locked and unlocked states as engine RPM passes through resonant points.

U.S. Pat. No. 5,327,859, entitled ENGINE TIMING DRIVE WITH FIXED AND VARIABLE PHASING by Pierik et al. teaches an engine timing drive for driving a camshaft and an accessory such as a balance shaft has a transmission member including a fixed phase output for driving the accessory and a variable phase output for driving the camshaft. A preferred embodiment incorporates a planetary cam phaser in a driven sprocket that also carries a fixed phase output gear as an accessory drive.

Further, there are a number of patents teaching methods or devices for dealing with resonance and related matters. These patents typically use tensioners whereby the tensioners are softened various means.

As can be appreciated, timing drives especially modern timing drives with their lower inertia and lower friction can develop resonances that can increase the load in the timing drive. This increase in load may be undesirable. Methods and apparatus are devised to reduce these high loads. The methods and apparatus include: making the tensioner softer by increasing the leakage of the tensioner and increasing the piston to bore clearance. The methods and apparatus further include: adding a torturous path vent plug; adding apressure relief; and adding a force release to the tensioner piston.

With the introduction of one or more cam phaser(s) into a timing drive, the increased inertia from the cam phaser can cause the engine speed at which the resonance occurs to change and may affect the operating speed of the engine operation. Typically, within a neighborhood of a particular engine speed, the tensional force exerted on a chain is bigger even than that at higher engine speeds. Therefore, it is desirable to use the newly added phaser for reducing resonance or undue tension of a timing drive.

SUMMARY OF THE INVENTION

A cam phaser is provided for reducing resonance or undue tension of a timing drive.

A cam phaser is provided for reducing the chain load of a timing drive.

In an engine timing chain system having a VCT phaser, a method is provided in which leakage of the phaser is increased to cause oscillation of the phaser for damping or softening the chain tension.

In an engine timing chain system having a VCT phaser, a method is provided in which leakage of the phaser is increased to cause oscillation of the phaser for damping or softening the chain tension at a neighborhood of engine speed.

A cam phaser associated with a timing drive is provided for reduction of timing drive resonance.

Accordingly, a method is used to change the duty cycle frequency of a PWM solenoid or the dither frequency of a current controlled solenoid driver to cause the spool valve to dither about null so as to increase the flow from chamber to chamber or to each portion of a cavity enclosing a 4-way control or spool valve. This increased flow will add more compliance to the timing drive system and reduce the resonance condition. The increase flow will take some energy from the timing drive and help dampen out the resonance frequency excitation.

Accordingly, in a chain drive device having a driving shaft, and a driven shaft, coupled together by an endless chain, a method is provided. The method includes the steps of: providing a phaser being interposed between the driving shaft and the driven shaft; and changing the oscillation rate of the phaser about at least one engine speed range. Thereby undue tension on the endless chain is reduced.

DESCRIPTION OF THE PREFERRED EMBODIMENT

Timing drives such as modem timing drives with their lower inertia and lower friction develop resonances in and around certain engine speed. The resonance frequency varies with difference engine system due to different distributions of mass of the related parts. The end result is increased load in the timing drive, especially at certain engine speeds or RPMs. The present invention uses a cam phaser for reducing resonance or undue tension of a timing drive.

Figure 1:
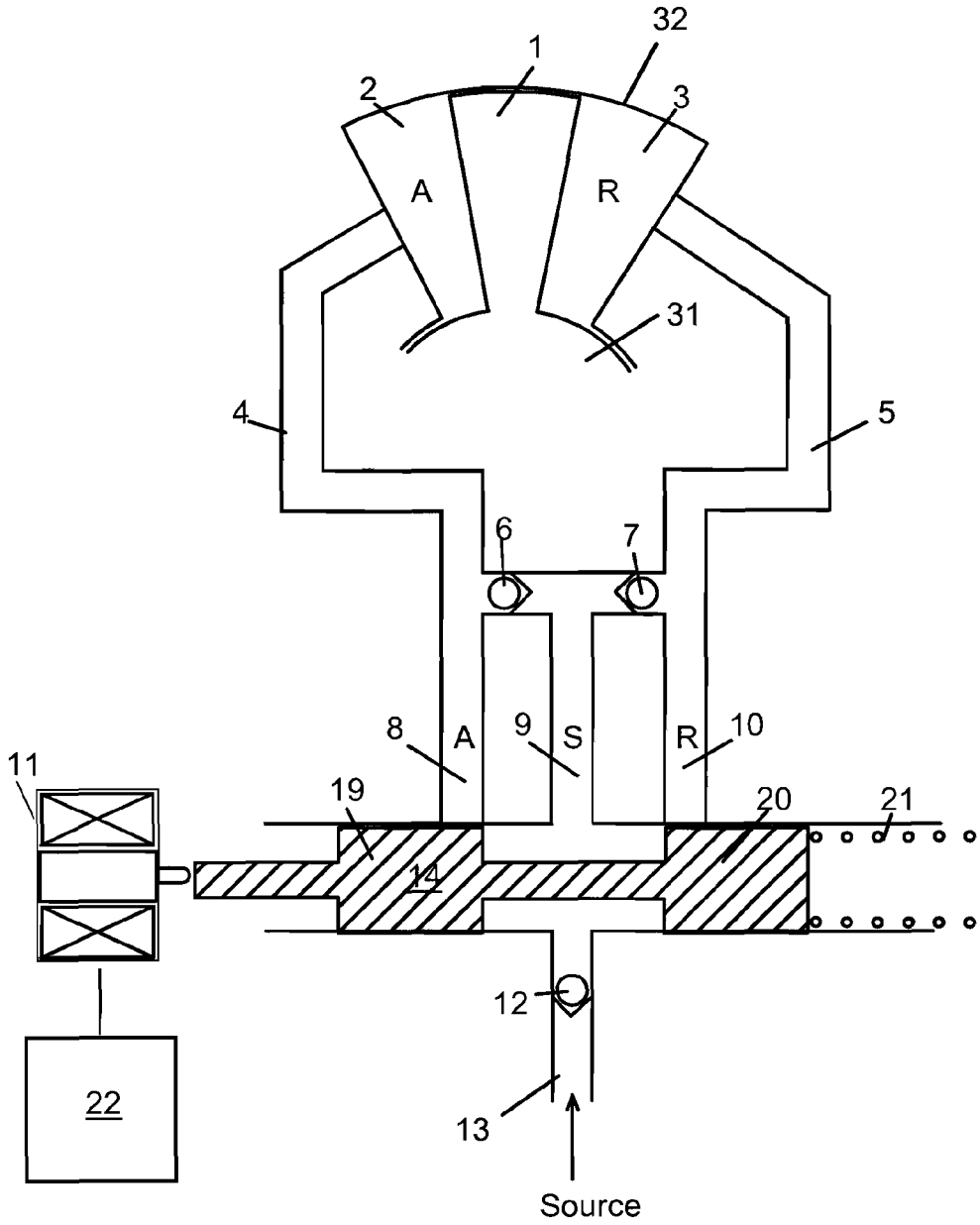
FIG. 1 shows a CTA phaser of the present invention.

Referring to FIG. 1, a Cam Torque Actuated (CTA) VCT system is shown. The CTA system uses torque reversals in camshaft caused by the forces of opening and closing engine valves to move vane 1. The control valve in a CTA system allows fluid flow from advance chamber 2 to retard chamber 3 or vice versa, allowing vane 1 to move, or stops flow, locking vane 1 in position. CTA phaser may also have oil input 13 to make up for losses due to leakage, but does not use engine oil pressure to move phaser. The phaser is typically made up of rotor 31, housing 32, spool valve 19, and check valves 6, 7. The housing 32 is defined as the outer part of phaser with chambers 2, 3. The rotor 31 is the inner part of the phaser, which is attached to a cam shaft 44.

The operation of CTA phaser system is as follows. FIG. 1 depicts a null position in that ideally no fluid flow occurs because the spool valve 14 stops fluid circulation at both advance end 8 and retard end 10. When cam angular relationship is required to be changed, vane 1 necessarily needs to move. Solenoid 11, which engages spool valve 14, is commanded to move spool 14 away from the null position thereby causing fluid within the CTA circulation to flow. It is pointed out that the CTA circulation ideally uses only local fluid without any fluid coming from source 13. However, during normal operation, some fluid leakage occurs and the fluid deficit needs to be replenished by the source 13 via a one way valve 12. The fluid in this case may be engine oil. The source 13 may be the engine oil pump.

There are two scenarios for the CTA phaser system. First, there is the Advance scenario, wherein an Advance chamber 2 needs to be filled with more fluid than in the null position. In other words, the size or volume of chamber 2 is increased. The advance scenario is accomplished by way of the following.

Solenoid 11, preferably of the pulse width modulation (PWM) type, pushes the spool valve 14 toward right such that the first land 19 of the spool valve 14 still stops fluid flow at the advance end 8. But simultaneously a second land 20 moved further right leaving retard portion 10 in fluid communication with duct 9. Because of the inherent torque reversals in camshaft, drained fluid from the retard chamber 3 feeds the same into advance chamber 2 via one-way valve 6 and duct 4.

Similarly, for the second scenario which is the retard scenario wherein a Retard chamber 3 needs to be filled with more fluid than in the null position. In other words, the size or volume of chamber 3 is increased. The retard scenario is accomplished by way of the following.

Solenoid 11, preferably of the pulse width modulation (PWM) type, reduces its engaging force with the spool valve 14 such that an elastic member 21 forces spool 14 to move left. The right portion 21 of the spool valve 14 stops fluid flow at the retard end 10. But simultaneously the first land 19 moves further left leaving Advance portion 8 in fluid communication with duct 9. Because of the inherent torque reversals in camshaft, drained fluid from the Advance chamber 2 feeds the same into Retard chamber 3 via one-way valve 7 and duct 5.

As can be appreciated, with the CTA cam phaser, the inherent cam torque energy is used as the motive force to re-circulate oil between the chambers 2, 3 in the phaser. This varying cam torque arises from alternately compressing, then releasing, each valve spring, as the camshaft rotates. The frequency at which this occurs is dependent on the rotational speed of the camshaft (e.g. ½ the engine speed) and the Cam Order (e.g. "3" for a V6 & V8, "4" for I4).

A control unit 22, such as the Engine Control Unit (ECU), is coupled to the solenoid 11 and controlling the same.

Thereby the movement of spool valve 14 is controlled by controller 22. Control unit 22 contains or controls the method contemplated by the present invention.

In addition, an independent controller may be used instead of relying solely upon the engine control unit (ECU). The independent controller may be coupled to the ECU and communicate with the same. In other words, proprietary information may be stored in the memory of the independent controller, and the same may work in conjunction with the ECU.

Figure 1A:
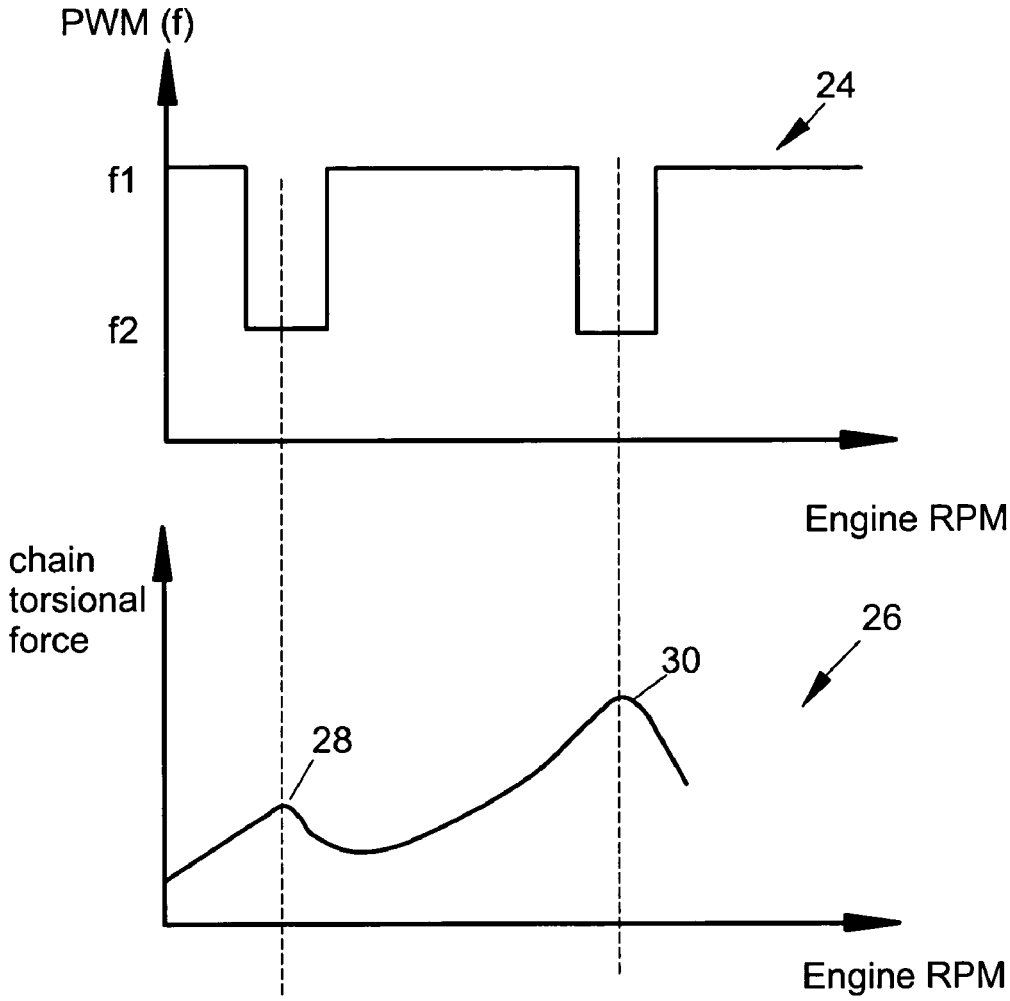
FIG. 1A shows control method of the present invention.

Referring to FIG. 1A, a control method of the present invention is shown. A first co-ordinate ordinate 24 shows the relationship between engine speed (rpm) and a PWM solenoid frequency preferably controlled by control unit 22. a second co-ordinate 26 shows the relationship between engine speed (rpm) and chain torsional force of a chain drive. As can be seen, the chain torsional force has two maximum values or two bumps at region 28 and region 30 respectively. By definition a maximum value is a value of a point, wherein all other values of points in the region is less than the maximum value. By way of example, in region 30 the increase of engine rpm chain torsional force increases innitially and after reaching the maximum value the torsional force actually decrease while engine rpm increases.

As shown in first co-ordinate 24, the PWM solenoid frequency is reduced from a first frequency $f_1$ to a second frequency $f_2$, wherein $f_1 > f_2$. This softens the phaser thereby allowing the chain torsional force to be reduced, the details of which is described infra. By way of an example, $f_1$ may be equal to 100 Hz, and $f_2$ may be equal to 50 Herz.

Figure 2:
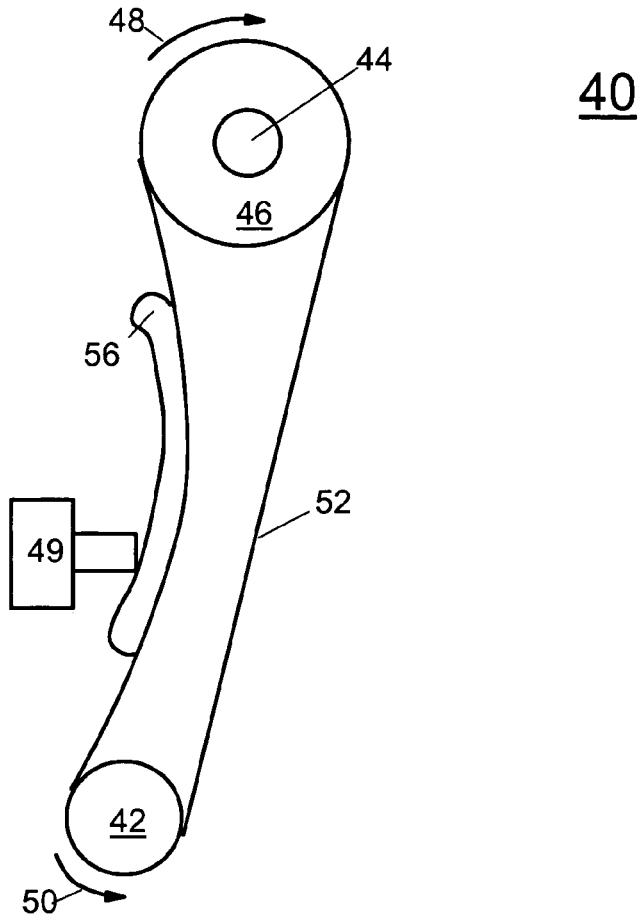
FIG. 2 shows a chain drive having a driving shaft and a driven shaft with a phaser interposed therebetween.
Figure 2A:
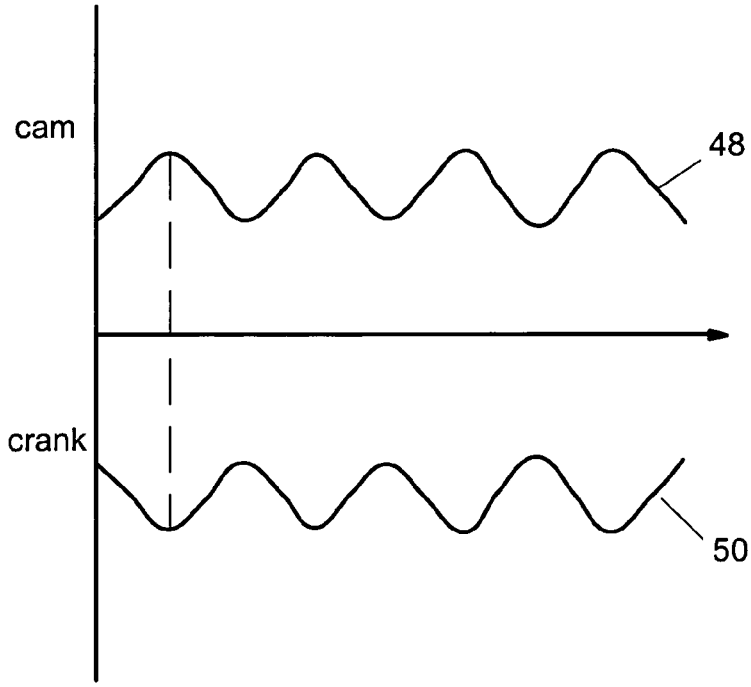
FIG. 2A shows the driven and the drive shafts having opposing (180° out of phase) torsional forces.

Referring to FIGS. 2 and 2A, a chain drive having a driving shaft 42 (e.g. crank shaft) and a driven shaft 44 (e.g. cam shaft) with a phaser 46 interposed therebetween is provided. The torsional forces 48, 50 exerted by the driving shaft 42 and the driven shaft 44 are shown. In a known manner, an endless chain 52 is looped around driving shaft 42 and driven shaft 44. There may be other members interposed between driving shaft 42 and driven shaft 44, for example, phaser 46 having a sprocket (not shown) on its circumference may be connected to chain 52. A similar member such as a sprocket may be interposed between chain 52 and driving shaft 42. A tensioner assembly including a tensioner 49 and a tensioning arm 56 is coupled to the chain 52 in a known manner.

Referring specifically to FIG. 1A, a scenario of force 48 and force 50 is shown. Force 48 is caused by the cam side of the chain assembly, and force 50 is caused by the crank side of the chain assembly. Force 48 and force 50 are 180 degrees out of phase in that the directions of the forces are exerted away from or against each other.

Figure 3:
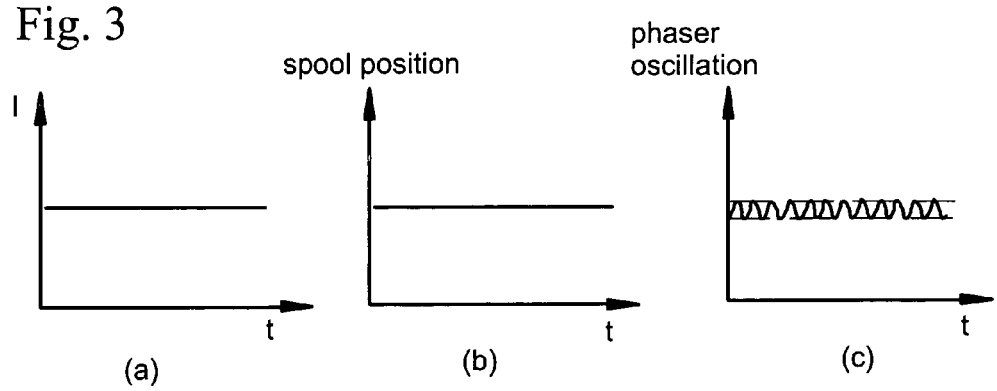
FIG. 3 shows a first relationship of the present invention.
Figure 4:
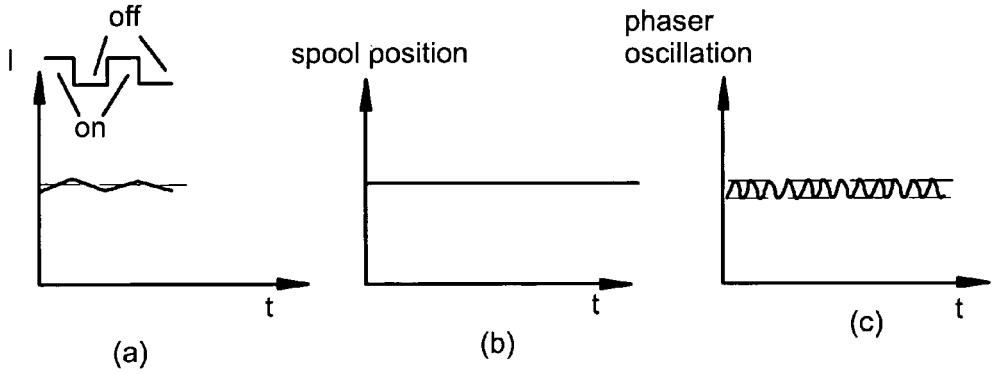
FIG. 4 shows a second relationship of the present invention.
Figure 5:
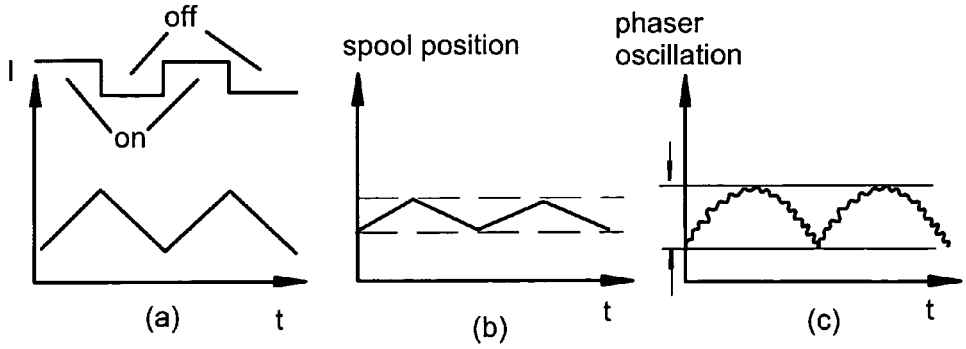
FIG. 5 shows a third relationship of the present invention.

The relationship between the control current on a actuator such as solenoid 11, spool 14 position, and phaser oscillation is depicted in FIGS. 3–5.

Referring to FIG. 3, an ideal control result is depicted. Control current I is constant over time. As a result, the control valve or spool 14 stays at a fixed position over time. In turn, the phaser merely oscillates slightly around its designated position. The slight oscillation is the result of the inherent control fluid leakage of the phaser.

Referring to FIG. 4, a normal phaser control relationship is shown. A control signal turn "ON" and "OFF" at a predetermined and relatively short intervals. As a result, control current I oscillates within a range. The controller and actuator combination would accumulate and than discharge the current I around a median current value which is depicted by a broken line. Current I itself is shown by the slightly sea-saw graph. As a result, the control valve or spool 14 stays at a fixed position over time in that the slightly sea-saw graph of current I is not sufficiently strong to move the control valve or spool 14. In turn, the phaser merely oscillates slightly around its designated position. The slight oscillation is the result of the inherent control fluid leakage of the phaser. It is noted that by adding a phaser to the timing drive system the resonant characteristics of the timing drive is altered. But the present invention teaches more than the mere addition of a phaser, although the addition reduces the tension on the chain.

Referring to FIG. 5, a control relationship implementing the teaching of the present invention is shown. Control current I oscillates within a range. This oscillation is caused by such things as a switch which turns on and off the current. The controller and actuator combination would accumulate and than discharge the current I around a median current value which is depicted by a broken line. Current I itself is shown by the increased sea-saw graph. As a result, the control valve or spool 14 follows or traces the increased sea-saw graph over time in that the increased sea-saw graph of current I is sufficiently strong to move the control valve or spool 14. In turn, the phaser merely oscillates more within an envelope of increased size. The increased oscillation is the result of the movement of the control valve which in turn causes the phaser to oscillate in a known manner. It is noted that by adding a phaser to the timing drive system the resonant characteristics of the timing drive is altered. But the present invention teaches more than the mere addition of a phaser, the present invention teaches a method wherein the phaser is allowed to oscillate more at certain engine speeds in order to reduce the tension on the chain 52. Of course, this is a balancing act in that when the tension on the chain 52 is undesirable such as over a predetermined value, the tension on the chain 52 can be softened by letting the phaser to oscillate more. However, the phaser is introduced, in part, for the control of timing of the chain 52. Therefore, if the chain 52 is slack, which is not the case when the chain 52 has excessive tensioning force exerted thereon, it may be undesirable to slacken the chain 52 more by allowing the phaser to oscillate more. This dilemma can be addressed by referring back to FIG. 1A in that at certain engine speed or region such as region 28 and region 30, the frequency of a control switch is decreased, while for the rest of the engine RPMs the frequency remains normal in the sense that whatever is required for controlling purposes remains as it is or was. The result is the lowered frequency which is also depicted in FIG. 5.

Figure 6:
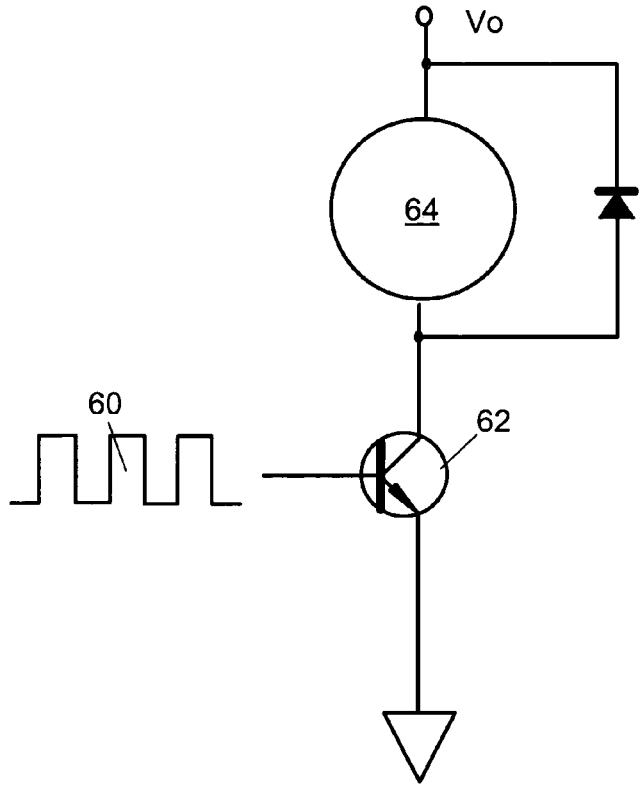
FIG. 6 shows a first control device of the present invention.
Figure 7:
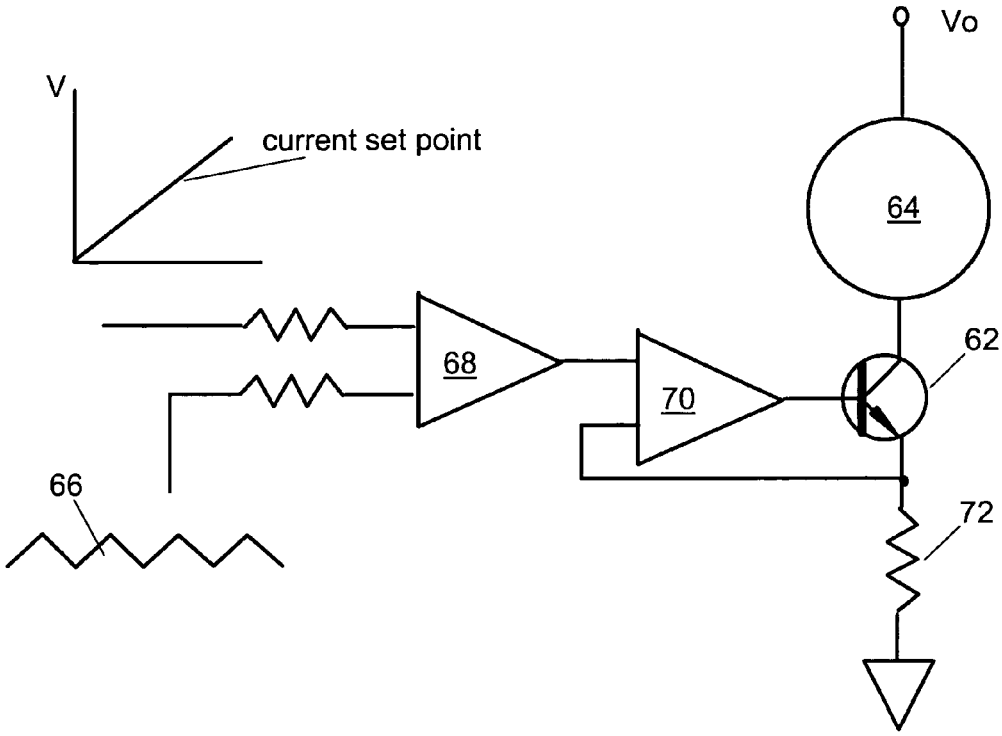
FIG. 7 shows a second control device of the present invention.

FIGS. 6 and 7 show some control switches suitable for the present invention. Referring to FIG. 6, a PWM solenoid control scheme, wherein a variable force solenoid is controlled by a pulse width modulation signal is shown. A control signal 60 is applied upon the input end or the base of a electronic switch 62, thereby allowing current on the output end to be "ON" or "OFF" in a predetermined way. This current will have the desired effect on an actuator 64, which is shown in FIG. 1 and may include controller 22, solenoid 11, and control valve 14, etc. a diode is provided which is used for recirculating the current through the coil when the transistor or switch 62 is turned off. This way the current will decrease slowly when the transistor is off thus averaging the current Referring to FIG. 7, a current control scheme, wherein the current control of a variable force solenoid is controlled by a linear driver is shown. Unlike FIG. 6, instead of pulses 60, the control signal herein is already a dither signal 66, which along with a current set point signal applied upon another input lead of a first amplifier 68 having its output applied upon one lead of a second amplifier 70 with another lead of the amplifier 70 being a sensing signal of a current sense resistor 72, thereby causing similar effect on the output end of switch 68 as that of FIG. 6.

As can be appreciated, the control signals 60, 66 can be predetermined in such a way that the result as depicted in FIG. 4 and FIG. 5 can be achieved respectively.

By way of an example implementing the present invention, the pulse width modulation (PWM) frequency are switched from its normal $f_1$=100 Hz to $f_2$=50 Hz at engine speeds of 2,000 rpm, 4,000 rpm, and 6,000 rpm respectively. The reason for the above switchings are that a set of local maximum values in chain tension occur thereabout. This local maximum values are similar to the depictions in FIG. 1A at region 28 or region 30. As can be appreciated, when the tension on the chain is high, slacken the chain somewhat generally does not affect the timing scheme relating to other control purposes.

The control current I for the control valve 14 is normally set to stay at 0.5 A for the optimal control with a range. The spool position is preset at the 2 mm position. The phaser oscillation stays within its inherent 1 degree range. This is the normal scenario where no excessive phaser oscillation occurs. However, when the chain tension is increased around the maximum points, the present invention introduces lower frequencies of 50 Hz to thereby cause the spool 14 move or oscillate within an envelope of 1.8 and 2.2 mm range. This movement in turn causes the phaser to oscillate about 2 degrees instead of one. This is sufficient to cause the tension of the chain to be reduced.

Figure 8:
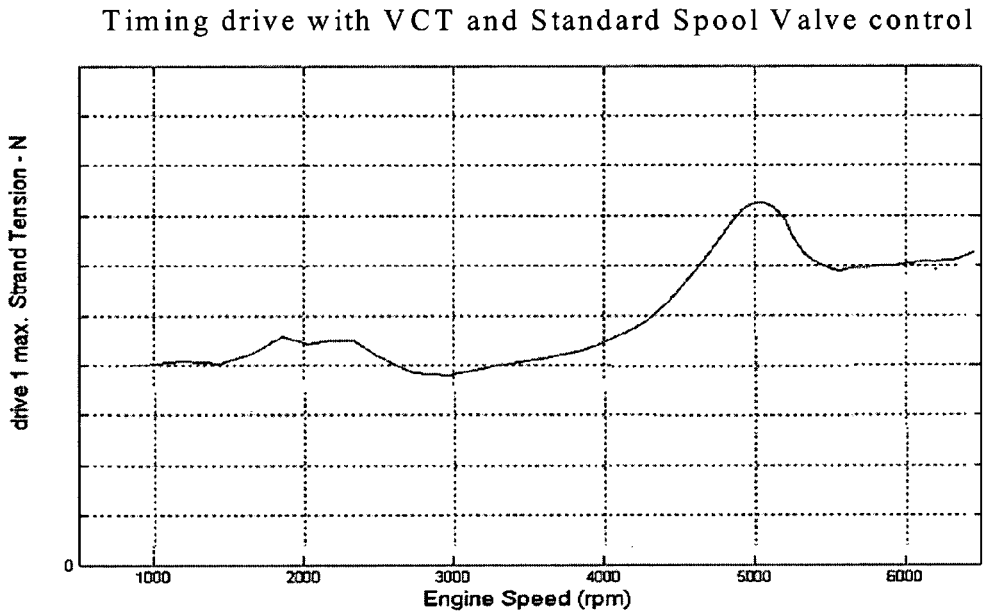
FIG. 8 shows a test result without incorporating the present invention.
Figure 9:
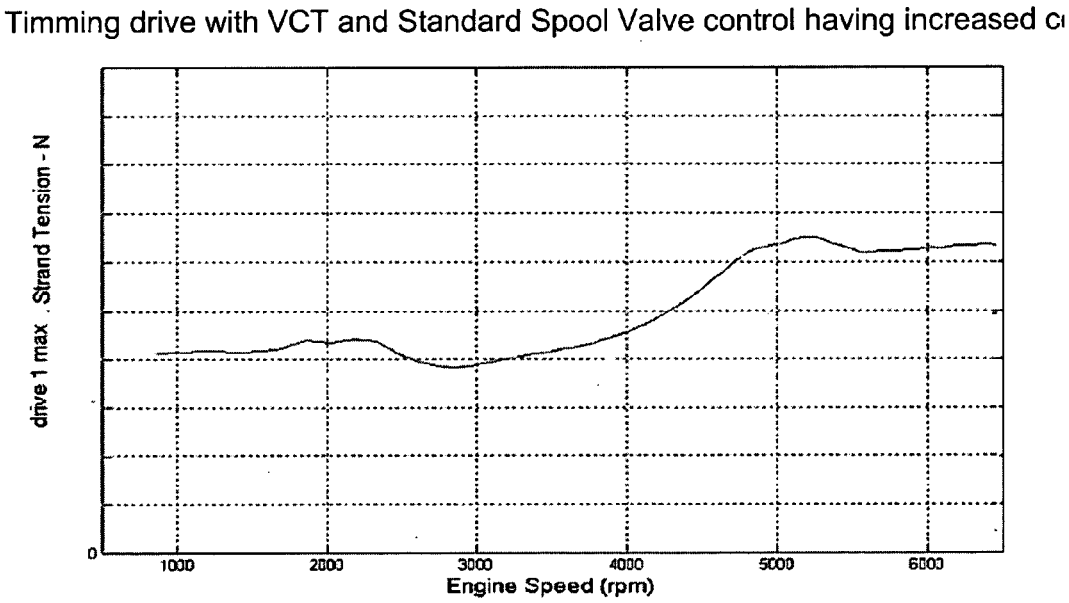
FIG. 9 shows a test result incorporating the present invention.

FIGS. 8 and 9 are experimental data relating to the present invention. Referring to FIG. 8, a timing drive with VCT and standard spool valve control is depicted. Note the local maximum value or the bump around 5,000 rpm. Referring now to FIG. 9, a timing drive with VCT and increased spool valve travel of the present invention is depicted. Note the reduction of the chain tension around 5,000 rpm.

The present invention uses a cam phaser that adds inertia to the timing drive but also adds compliance to the timing drive and reduce the timing drive resonance chain load. The present invention teaches a method to do this by adding leakage to the phaser so that the oscillation of the phaser is increased. The present invention solves the problem of reduced chain tension at lower engine speeds by selectively increase phaser oscillate only at certain engine speeds.

In a TA and OPA VCT system, allowing the spool to dither back and forth will open one chamber to exhaust momentarily and close it off and then open the other chamber to exhaust and then close it off. This will effectively increase the flow out of the phaser and add compliance to the timing drive system in that chain tension can be reduced.

In a CTA system, allowing the spool to dither back and forth will allow oil from one chamber to flow into the other chamber and then back to the original chamber. This will increase the oscillation of the phaser and add compliance to the timing drive to help reduce the resonance condition.

Accordingly a method is used to change the duty cycle frequency of a PWM solenoid or the dither frequency of a current controlled solenoid driver to cause the spool valve to dither about null so as to increase the flow from chamber to chamber. This increased flow will add more compliance to the timing drive system and reduce the resonance condition. The increase flow will take some energy from the timing drive and help dampen out the resonance frequency excitation.

There are two ways to increase the oscillation open loop and closed loop. The open loop method is to have a mapped duty cycle frequency and change it to a set frequency at set engine speed condition. The closed loop method is to measure the cam phaser oscillation and adjust the duty cycle frequency to control the amount of oscillation of the camshaft.

We have tested this on a CTA cam phaser equipped engine and have shown that the oscillation of the cam phaser can be increased by changing the duty cycle frequency of a PWM controlled solenoid.

Modeling shows a 14% decrease in chain tensioner by increasing the effective leakage of the phaser during a resonance period.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA)VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Chamber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is most often located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA)or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A method of increasing compliance in a chain drive timing drive system having a driving shaft; and a driven shaft, coupled together by an endless chain, a phaser interposed between the driving shaft and driven shaft having a spool valve with an advance position for moving the phaser to an advance position, a retard position for moving the phaser to a retard position, and a null position for preventing movement of the phaser, and a controller for determining the position of the phaser, the method comprising the steps of:

when the controller determines the spool valves is in a commanded position or in the null position, repeatedly moving the spool valve towards the advance position and towards the retard position at a rate related to engine rotational speed, the movement of the spool valve permitting oscillation of the phaser through fluid movement.

2. The method of claim 1, wherein the phaser interposed between the driven shaft and the driving shaft of the chain drive system is cam torque actuated (CTA).

3. The method of claim 1, wherein the phaser interposed between the driven shaft and the driving shaft of the chain drive system is oil pressure actuated (OPA).

4. The method of claim 1, wherein the the phaser interposed between the driven shaft and the driving shaft of the chain drive system is torsion assist (TA).

5. The method of claim 1, wherein the spool valve is positioned by a solenoid.

6. The method of claim 1, wherein the oscillation of the phaser is varied based on engine speed related resonances in the chain.

7. The method of claim 5, wherein the solenoid is a pulse width modulated solenoid.

8. The method of claim 5, wherein the solenoid is a linear drive.

* * * * *